United States Patent [19]

Mori

[11] Patent Number: 4,625,663

[45] Date of Patent: Dec. 2, 1986

[54] WORK CUTTING ATTACHMENT FOR ZIGZAG SEWING MACHINES

[76] Inventor: Mikio Mori, 12-2, Chidori-cho 3-chome, Ogaki-shi, Gifu-ken, Japan

[21] Appl. No.: 826,383

[22] Filed: Feb. 5, 1986

[30] Foreign Application Priority Data

Feb. 5, 1985 [JP] Japan ..... 60-21098
Aug. 28, 1985 [JP] Japan ..... 60-190275

[51] Int. Cl.[4] ..... D05B 37/06

[52] U.S. Cl. ..... 112/128; 112/151; 112/443

[58] Field of Search ..... 112/128, 151, 153, 122, 112/122.1, 443, 235, 122.2, 122.3, 122.4, 123

[56] References Cited

U.S. PATENT DOCUMENTS

| | | | |
|---|---|---|---|
| 485,538 | 11/1892 | Forbes et al. | 112/128 |
| 2,048,268 | 7/1936 | Kucera | 112/128 |
| 4,389,952 | 6/1983 | Dreier et al. | 112/128 |
| 4,463,693 | 8/1984 | Dreier et al. | 112/128 |
| 4,572,089 | 2/1986 | Nishi | 112/128 |

*Primary Examiner*—Werner H. Schroeder
*Assistant Examiner*—Andrew M. Falik
*Attorney, Agent, or Firm*—Dennison, Meserole, Pollack & Scheiner

[57] ABSTRACT

A work cutting attachment for use with a zigzag sewing machine having a reciprocatory needle bar, a presser bar and a feed dog. The attachment includes a base plate, a mounting mechanism for removably securing the base plate to the presser bar, an interlocking mechanism pivotally supported on the base plate and engageable with the needle bar for vertical swinging movement therewith, a movable and a fixed knife disposed generally behind the needle bar relative to the direction of work advancement, a guide member for guiding the fabric chip cut by the knives in a direction moving away from the work fabric to be sewn, and a presser foot disposed generally below the needle bar and cooperating with the feed dog to hold and feed the work fabric to be sewn.

12 Claims, 12 Drawing Figures

WORK CUTTING ATTACHMENT FOR ZIGZAG SEWING MACHINES

BACKGROUND OF THE INVENTION

1. Field of the Invention

The present invention relates to work cutting attachments for zigzag sewing machines and more particularly, it relates to such attachments in which the work cutting operation is performed by using the drive of the sewing machines.

2. Description of the Prior Art

Heretofore, such cutting attachments have been used, particularly in zigzag sewing machines, to cut the hem of a work fabric while it is hemstitched with various stitches. The previously known cutting attachments are of the type secured to the table of a sewing machine by means of screws. For this reason, therefore, it has been necessary to form individual screw holes in sewing machines. Generally, it is difficult, if not impossible, for the user of sewing machines to provide such screw holes for himself, and in order to use such cutting attachments, the user has to purchase a specific sewing machine having individual screw holes for mounting the cutting attachments. Thus, the versatility of previously known cutting attachments is significantly reduced.

Additionally, when such cutting attachments are used for ordinary zigzag sewing machines, trim or chips produced by the cutting attachment tend to be caught on the presser foot of the sewing machine and to be curled thereby. Thus, work advancement and sewing operation may sometimes be impeded.

SUMMARY OF THE INVENTION

It is, accordingly, an object of the present invention to provide a novel attachment for cutting a work fabric which may be readily mounted to a zigzag sewing machine without making special provision therefor.

It is another object of the present invention to provide a flexible cutting attachment which may be used for all types of ordinary household sewing machines.

It is a further object of the present invention to provide a novel cutting attachment including a presser foot which may feed the work fabric smoothly without curling the chips cut by the attachment.

According to the present invention, there is provided a work cutting attachment for use with a zigzag sewing machine having an endwise reciprocatory needle bar, a presser bar and a feed dog. The attachment comprises a base plate, mounting means for removably securing the base plate to the presser bar of the sewing machine, interlocking means pivotally supported on the base plate and engageable with the needle bar for vertical swinging movement therewith, a movable and a fixed knife disposed generally behind the needle bar relative to the direction of work advancement, a guide member for guiding the fabric chip cut by the knives in a direction away from the work fabric to be sewn, and a presser foot disposed generally below the needle bar and cooperating with the feed dog to hold and feed the work fabric to be sewn, the presser foot having a needle clearance aperture formed centrally therein.

In a preferred embodiment of the invention, the mounting means includes a mounting arm and a screw. The mounting arm is fixedly connected at one end to the base plate and at the other end to the presser bar through the screw.

The interlocking means includes a first transverse lever, a second transverse lever, and an intermediate shaft operatively connecting the first lever with the second lever. The first lever is pivotally carried on the base plate and has one end slidably pivoted to the needle bar for substantially vertical swinging movement therewith. The intermediate shaft is slidably connected at one end to the other end of the first lever. The second lever is pivotally carried on the base plate at the opposite end remote from the first lever and has one end fixedly connected to the other end of the intermediate shaft.

The presser foot is pivoted to a support arm secured to the base plate. Preferably, the presser foot has a by-pass slot for by-passing the machine thread which extends from the needle clearance aperture to the exterior. Thus, the work advancement may be properly effected without being hindered by the starting ends of threads. The pressor foot also has a projecting piece extending toward the needle clearance aperture adjacent the by-pass slot, providing a width slightly smaller than the width of the needle clearance aperture at the needle locations. Thus, uniform width of stitches may be obtained at all times.

The present invention will become more fully apparent from the claims and description as it proceeds in connection with the drawings.

DETAILED DESCRIPTION OF THE PREFERRED EMBODIMENT

Figure 1:
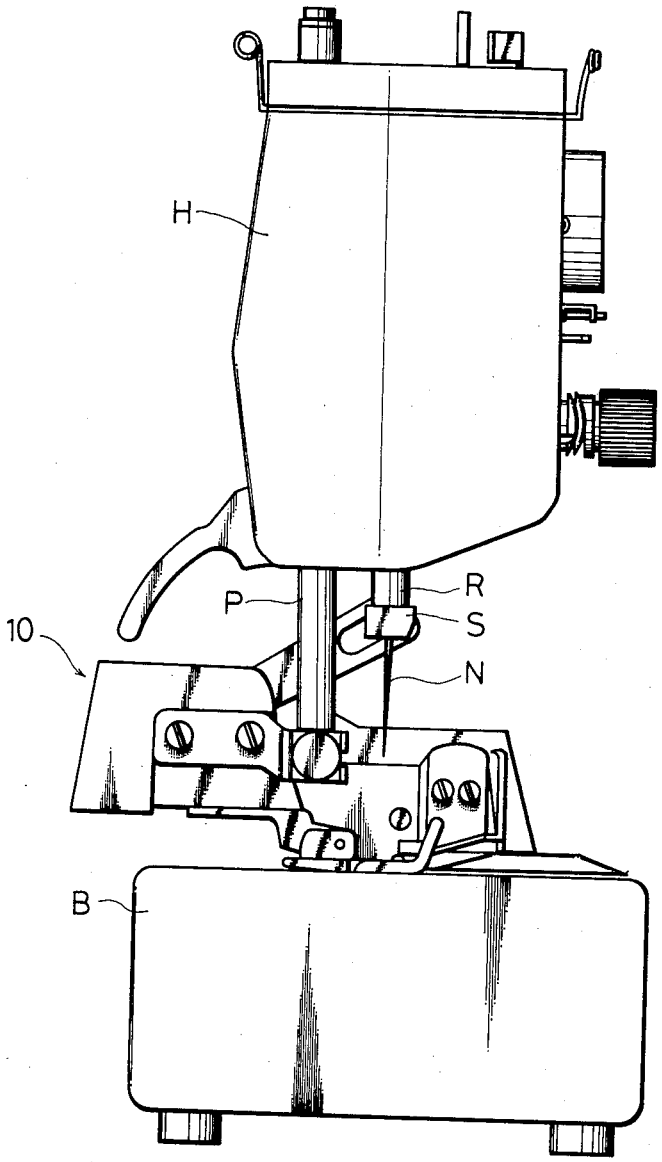
FIG. 1 is a side view of a work cutting attachment of the present invention applied to a zigzag sewing machine.

Referring to the drawings and to FIG. 1 in particular, the work cutting attachment 10 of the present invention is illustrated as applied to a zigzag sewing machine. As shown therein, the machine includes a head H, a presser bar P, a reciprocable needle bar R, a needle clamp S, a needle N, and a bed B. The attachment 10 of the present invention is disposed on the bed B and is attached to the presser bar P as will be hereinafter described in greater detail.

Figure 2:
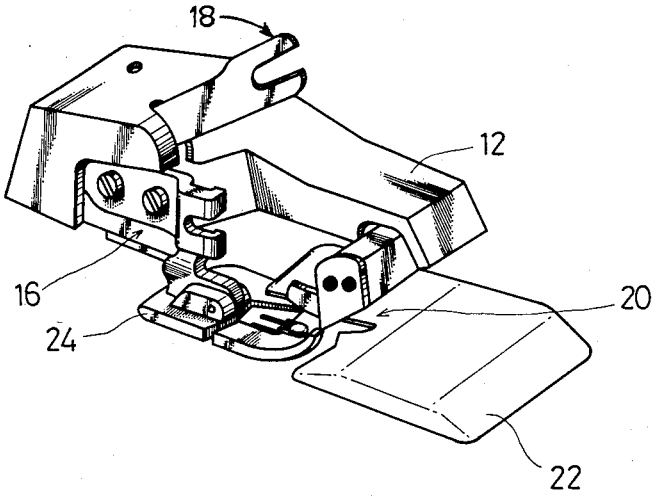
FIG. 2 is a perspective view of the attachment.

Referring to FIG. 2, the attachment 10 of the present invention is shown in perspective view. As may be seen, the attachment 10 includes a cover 12, a mounting mechanism 16 for securing the attachment 10 to the presser bar P, an interlocking mechanism 18 operable with the needle bar R, a work cutting mechanism 20 actuated by the interlocking mechanism 18, a guide member 22 for guiding a work fabric to the cutting mechanism 20, and a presser foot 24 for holding the fabric against a feed dog of the sewing machine to feed the same forwardly.

The construction of the attachment 10 will now be described in greater detail with reference to FIGS. 3 to 7.

Figure 3:
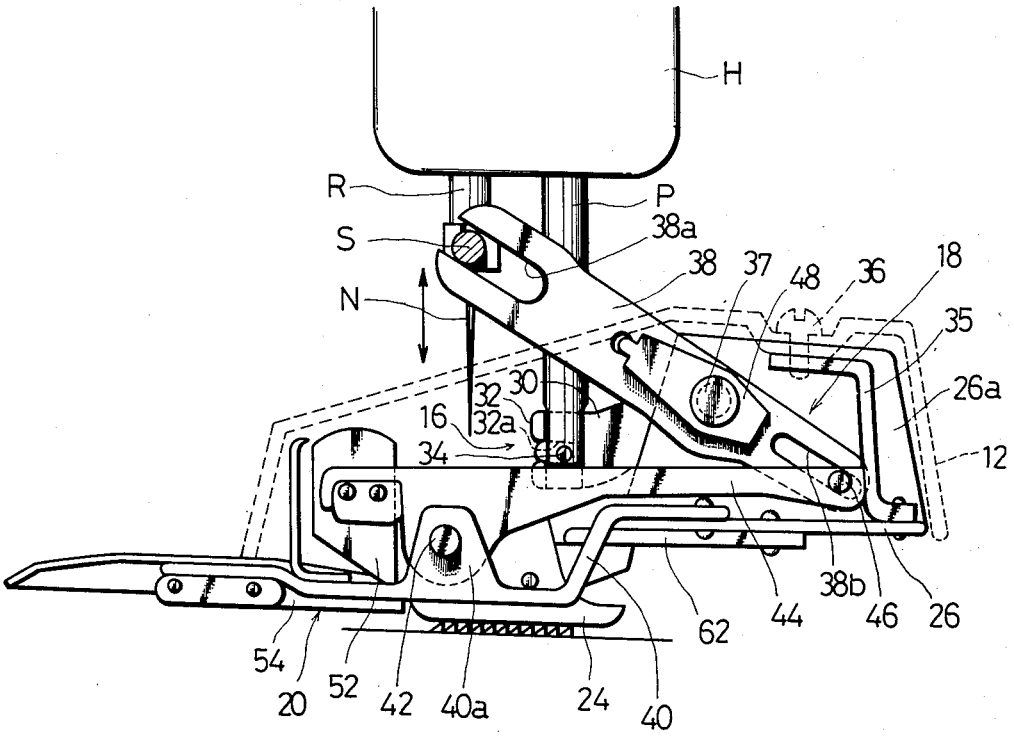
FIG. 3 is a side view, with the cover removed for clarity, of the attachment as seen looking from the opposite side of FIG. 1.
Figure 4:
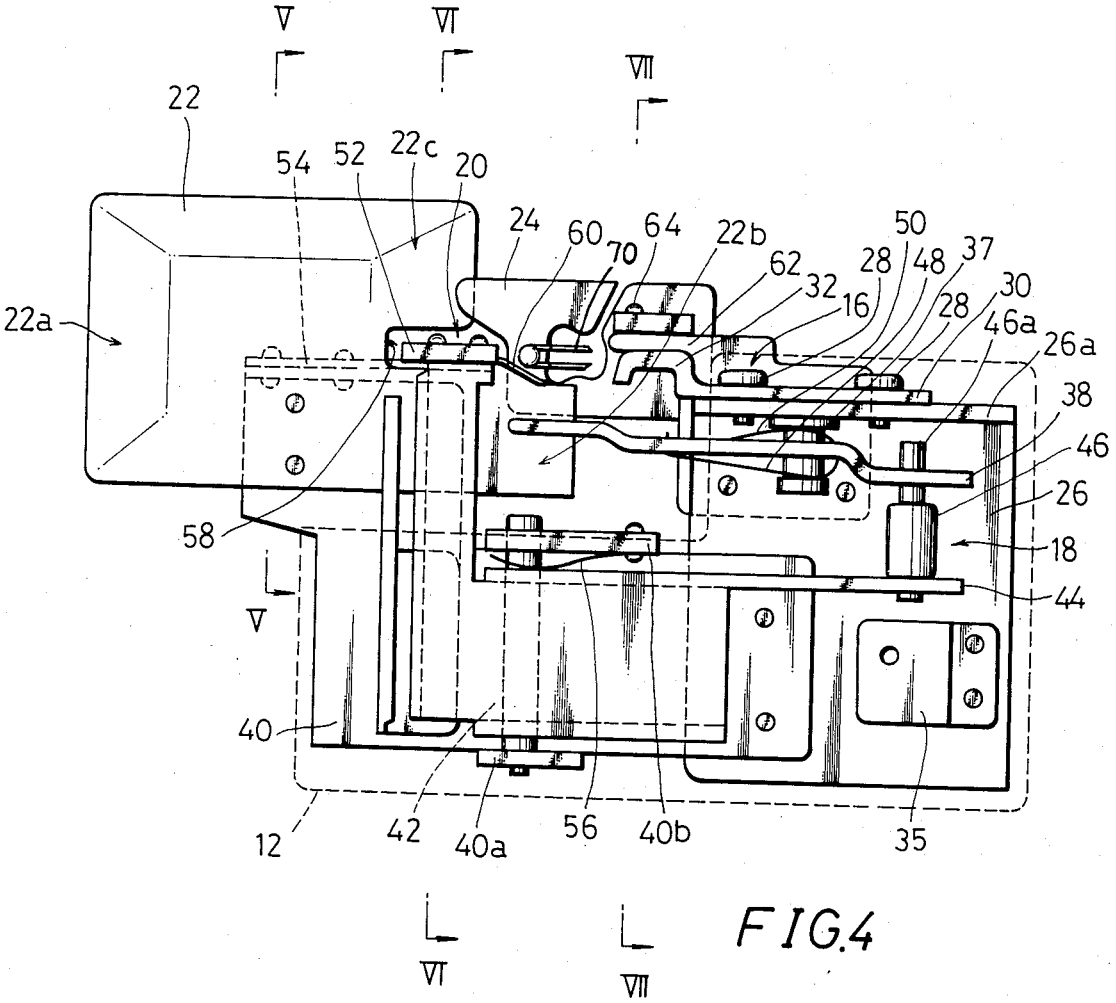
FIG. 4 is a plan view of the attachment shown in FIG. 3.

Referring particularly to FIGS. 3 and 4, the mounting mechanism 16 includes a mounting arm 30 extending to the presser bar P and secured to an upstanding portion 26*a* of a base plate 26 through screws 28. The mounting arm 30 has at one end a crooked portion 32 for engagement with the presser bar P. The crooked portion 32 has formed therein a cutout portion 32*a* through which a set screw 34 is received. Thus, the mounting arm 30 is removably secured by the set screw 34 to the presser bar P. It is to be noted that the crooked portion 32 partly encircling the presser bar P serves to prevent possible lateral movement of the mounting arm 30 relative to the presser bar P, thus firmly securing the attachment 10 to the presser bar P.

The base plate 26 has adjacent the forward end thereof a mounting frame 35 for securing the cover 12 thereto. The cover 12 is secured to the mounting frame 35 by means of a screw 36.

Figure 6:
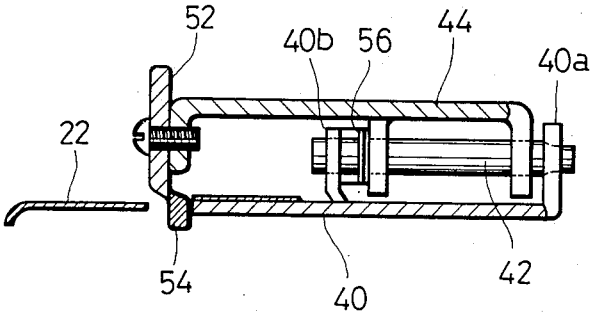
FIG. 6 is a sectional view taken along line VI—VI in FIG. 4.
Figure 7:
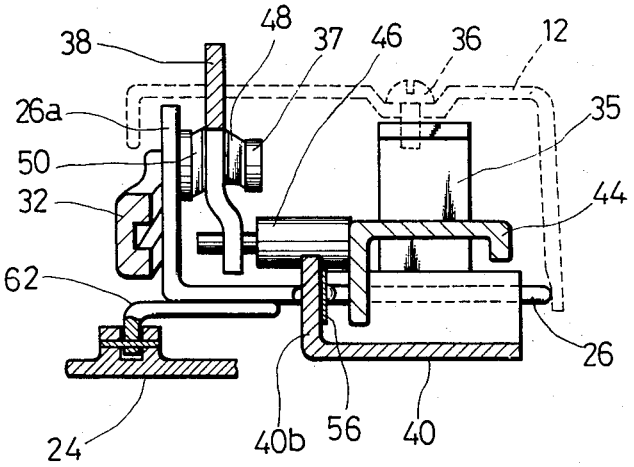
FIG. 7 is a sectional view taken along line VII—VII in FIG. 4.

The interlocking mechanism 18 includes a first transverse lever 38 and a second transverse lever 44. Specifically, as shown in FIG. 3, the first lever 38 is pivotally connected to a pin 37 secured to the upstanding portion 26*a* of the base plate 26. A support plate 40 is provided and is rivetted to the rearward portion of the base plate 26. As shown in FIGS. 4 and 6, the support plate 40 has secured thereto a pair of spaced apart upstanding lugs 40*a* and 40*b* between which a support shaft 42 is fixedly connected. The second lever 44 is pivotally supported by the support shaft 42 and is provided with an intermediate shaft 46 secured at one end thereof.

Turning to FIG. 3, the first lever 38 has at one end thereof a longitudinally elongated cutout portion 38*a* in which the cylindrical boss of the needle clamp S is embraced. By means of this arrangement, the first lever 38 is pivotable about the pin 37 in accordance with the vertically reciprocating movement of the needle bar R. The first lever 38 also has at the other end thereof a slot 38*b* through which a projection 46*a* of the intermediate shaft 46 is received, thus transmitting the vertically reciprocating movement of the needle bar R to the second lever 44 through the intermediate shaft 46. As shown in FIG. 4, the first lever 38 is pivotally supported by the pin 37 in spaced relation thereto so that the first lever 38 may be slightly shifted in the axil direction of the pin 37. Thus, even if there exists some positional discrepancy between the first lever 38 and the needle bar R, the drive power may be positively transmitted in operative association with the cutout portion 38*a*. Additionally, the first lever 38 is provided with leaf springs 48 and 50 each disposed on the opposite sides thereof adjacent the pin 37, which assist the first lever 38 to follow the endwise reciprocating movement of the needle bar R during sewing operation.

Figure 5:
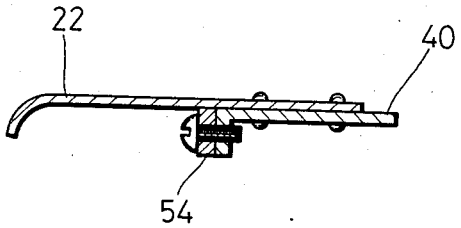
FIG. 5 is a sectional view taken along line V—V in FIG. 4.

The cutting mechanism 20 includes a movable knife 52 and a fixed knife 54 disposed immediately behind the needle bar R relative to the direction of work advancement. Specifically, the movable knife 52 is secured to the other end of the second lever 44 remote from the end carrying the intermediate shaft 46. The fixed knife 54 is secured to the support plate 40 generally below the movable knife 52 as shown in FIG. 5. The arrangement of the movable knife 52 is such that during the up-and-down reciprocating movement through the second lever 44, the movable knife 52 is always located below the upper edge of the fixed knife 54. Also, as shown in FIG. 6, the movable knife 52 on the second lever 44 is biased into resiliently pressing contact with the fixed knife by means of a leaf spring 56 acting between the second lever 44 and the lug 40*b*, thereby permitting reliable cutting operation at all times.

The guide member 22 has a support face 22*a* on which the end portion of a work fabric is placed, and has a first and a second guide face 22*b* and 22*c* extending at the opposite sides of a gap 58 through which the fixed knife 54 extends. The task of the first guide face 22*b* is to guide the fabric chip cut by the cutting mechanism 20; and the task of the second guide face 22*c* is to guide the work fabric to be hemstitched. Both the first guide face 22*b* and the second guide face 22*c* are sloped downwardly. The slope of the first guide face 22*b* is less than that of the second guide face 22*c* in order that the first guide face 22*b* guides the fabric chip to be removed to the upper face of the presser foot 24; and the second guide face 22*c* guides the work fabric to be hemstitched to the underside of the presser foot 24. Also, the first guide face 22*b* is provided with a guide bar 60 disposed immediately before the fixed knife 54 and which serves to separate the fabric chip cut by the cutting mechanism 20 away from the work fabric to be hemstitched, thus smoothly advancing the fabric chip to be removed.

Figure 8:
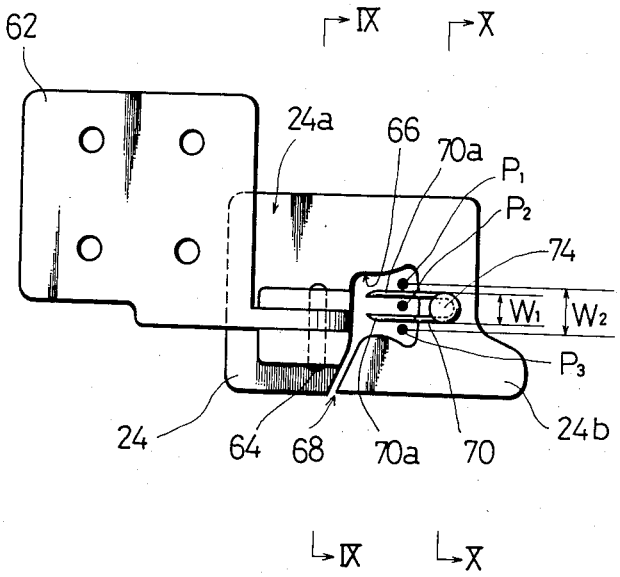
FIG. 8 is a plan view of the presser foot.
Figure 9:
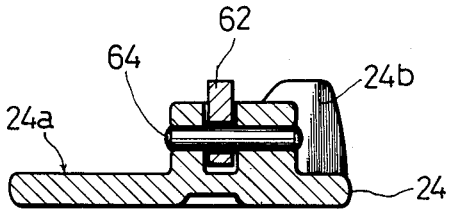
FIG. 9 is an enlarged sectional view taken along line IX—IX in FIG. 8.
Figure 10:
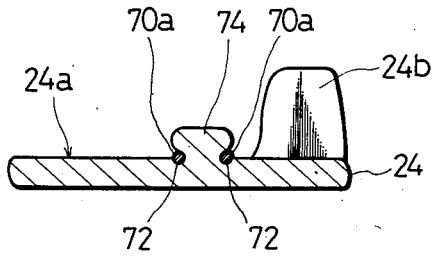
FIG. 10 is an enlarged sectional view taken along line X—X in FIG. 9.

Referring now more specifically to FIGS. 8 to 10, the presser foot 24 is pivoted by a pin 64 to a support arm 62 rivetted to the base plate 26. The presser foot 24 is located immediately below the needle bar R and adapted to hold the work fabric to be hemstitched against the feed dog of the sewing machine. The presser foot 24 has centrally therein a needle clearance aperture 66. The aperture 66 is open to the exterior through a by-pass slot 68. The task of the by-pass slot 68 is to direct the starting ends of threads outwardly therethrough when a sewing operation is started, and to this end, the slot 68 has a cross-sectional configuration diminishing in breadth from upside to downside.

The upper face 24*a* of the presser foot 24 on which the fabric chip to be removed is advanced is flat so that the chip being removed may be smoothly discharged without being caught by the presser foot 24. Additionally, the presser foot 24 has an upwardly bent portion 24*b* formed at the rear end thereof. The task of this bent portion 24*b* is to guide the fabric to be hemstitched to the underside of the presser foot 24.

As may be seen from FIG. 8, the pin 64 is disposed forwardly of the needle clearance aperture 66. Also, the pin 64 is loosely supported on the support arm 62 (FIG. 9), thereby permitting the presser foot 24 to swing slightly endwise. It is to be noted that the laterally pivotal movement of the presser foot 24 is restricted within a predetermined range by the lower end of the support arm 62 and the lower end of the guide member 22, as may be seen from FIGS. 4 and 8.

The presser foot 24 also has a substantially U-shaped steel wire 70 which serves to prevent possible shrinkage of the fabric end which may be caused by the endwise tension of the thread during hemstitch sewing. As best shown in FIG. 10, the closed end of the steel wire 70 is received in a complementary U-shaped groove 72. Specifically, a projection 74 is formed integrally with the presser foot 24 and crimped to secure the bent portion of the wire 70. A pair of arms 70*a* extend in parallel relation toward the center of the needle clearance aperture 66. FIG. 8 shows the arrangement of the arms 70*a* in relation to three needle locations $P_1$, $P_2$ and $P_3$ employed in an ordinary zigzag sewing machine. As may be seen, the distance $W_1$ between the arms 70*a* is set to be slightly narrower than the distance $W_2$ (or stitch width) between outer needle locations $P_1$ and $P_3$. This design point is applicable also to a zigzag sewing machine having four needle locations, the distance $W_2$ being the distance between outer two needle locations. The function of the arms 70*a* will hereinafter be described in greater detail.

The overall operation of the attachment 10 will now be described with reference to FIGS. 11 and 12.

Upon starting of the sewing machine, the needle bar R is vertically reciprocated, thereby causing the movable knife 52 of the cutting mechanism 20 to vertically move relative to the fixed knife 54. Now, the attachment 10 is ready to cut a work fabric C.

Figure 11:
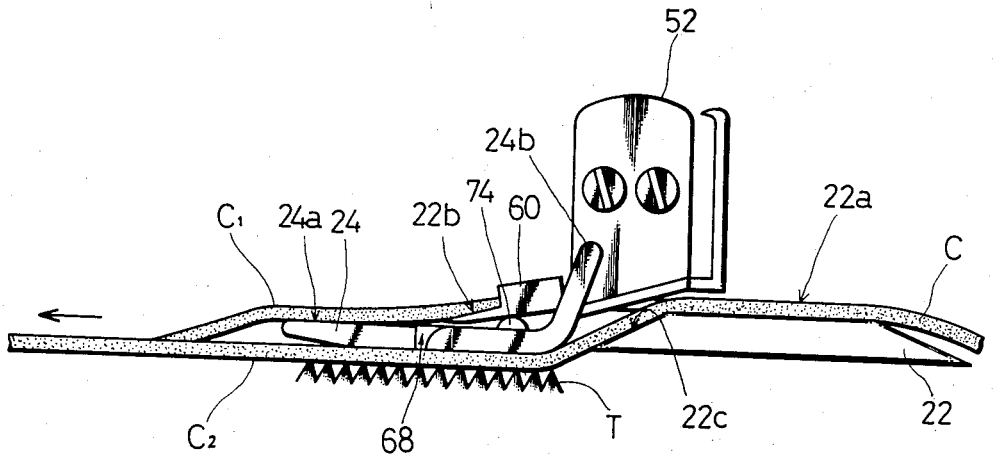
FIG. 11 is a schematic representation illustrating the work cutting and feeding operation of the attachment.

With the attachment 10 in this position, when the work fabric C is fed forwardly as it is placed on the support face 22*a* of the guide member 22, the fabric C is cut by the cutting mechanism 20 into a first fabric section or chip $C_1$ to be removed and a second fabric section or original work fabric $C_2$ to be hemstitched, as shown in FIG. 11. The chip $C_1$ is moved along the first guide face 22*b* of the guide member 22 and is directed by the guide bar 60 in a direction in which the chip $C_1$ moves away from the work fabric $C_2$. The chip $C_1$ is then moved along the upper face 24*a* of the presser foot 24 to be ultimately discharged. On the other hand, the work fabric $C_2$ is introduced in between the underside of the presser foot 24 and the feed dog T of the sewing machine. Thus, the work fabric $C_2$ is hemstitched as it is fed forwardly by the feed dog T.

Figure 12:
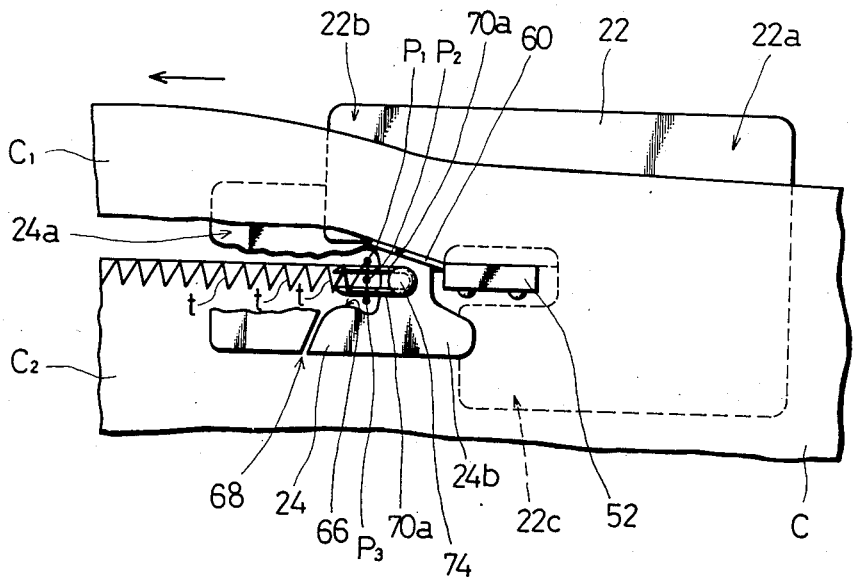
FIG. 12 is a plan view of FIG. 11.

As shown in FIG. 12, during the noted sewing process, the hemstitching is performed in a manner overriding the steel wire 70 of the presser foot 24, the arms 70*a* serving to maintain the opposite ends of the endwise swinging thread t in positions corresponding to the respective needle locations $P_1$ and $P_3$. Thus, endwise deviation of thread t and hence shrinkage of the fabric in stitching region may be prevented, providing excellent hemstitches from the view point of appearance and strength. It is to be noted that the stitched thread portion t is removed from the arms 70*a* as the work fabric $C_2$ is advanced, there being no possibility of hindering the sewing operation.

While the invention has been described with reference to preferred embodiments thereof, it is to be understood that modifications or variations may be easily made without departing from the spirit of this invention which is defined by the appended claims.

What is claimed is:

1. A work cutting attachment for use with a zigzag sewing machine having an endwise reciprocatory needle bar, a presser bar and a feed dog, comprising:

a base plate;

mounting means for removably securing said base plate to said presser bar of said sewing machine;

interlocking means pivotally supported on said base plate and engageable with said needle bar for vertical swinging movement therewith;

a movable and a fixed knife disposed generally behind said needle bar relative to the direction of work advancement;

a guide member for guiding the fabric chip cut by said knives in a direction away from the work fabric to be sewn; and a presser foot disposed generally below said needle bar and cooperating with said feed dog to hold and feed the work fabric to be sewn, said presser foot having a needle clearance aperture formed centrally therein.

2. The work cutting attachment as defined in claim 1 wherein said mounting means includes:

a mounting arm having one end fixedly connected to said base plate and the other end extending toward said presser bar; and a screw for securing said other end of said mounting arm to said presser bar.

3. The work cutting attachment as defined in claim 2 wherein said mounting arm has at said other end a crooked portion engageable with said presser bar and serving to prevent lateral movement thereof relative to said presser bar.

4. The work cutting attachment as defined in claim 1 wherein said interlocking means further comprises:

a first transverse lever pivotally carried on said base plate and having one end slidably pivoted to said needle bar for substantially vertical swinging movement therewith;

a longitudinal intermediate shaft slidably connected at one end to the other end of said first transverse lever; and a second transverse L-shaped lever pivotally carried on said base plate at the opposite end remote from said first transverse lever, said second transverse lever having one end fixedly connected to the other end of said intermediate shaft and the other end disposed generally behind said needle bar.

5. The work cutting attachment as defined in claim 4 wherein said movable knife is secured to the other end of said second transverse lever generally behind said needle bar, and wherein said fixed knife is secured to said base plate generally below and in operative association with said movable knife.

6. The work cutting attachment as defined in claim 1 wherein said guide member includes:

a guide bar disposed immediately before said movable and fixed knives relative to the direction of work advancement and adapted to direct the fabric chip cut by said knives in a direction moving away from the fabric to be sewn; and a guide face for guiding the fabric chip directed by said guide bar to the upper face of said presser foot.

7. The work cutting attachment as defined in claim 1 wherein said presser foot is pivoted by a pin to a support arm secured to the base plate.

8. The work cutting attachment as defined in claim 7 wherein said pin is located forwardly of said presser bar relative to the direction of work advancement.

9. The work cutting attachment as defined in claim 1 wherein said presser foot has an upper flat face adapted to receive the fabric chip cut by said knives.

10. The work cutting attachment as defined in claim 1 wherein said presser foot has a by-pass slot extending from said needle clearance aperture to the exterior thereof and adapted for by-passing the starting portions of sewing threads.

11. The work cutting attachment as defined in claim 1 wherein said presser foot has a projecting piece extending toward said needle clearance aperture and having a width slightly narrower than the width of endwise needle locations.

12. The work cutting attachment as defined in claim 11 wherein said projecting piece comprises a steel wire of substantially U-shaped configuration connected at its closed end to said presser foot.

* * * * *